United States Patent [19]

Jones et al.

[11] Patent Number: 4,571,119

[45] Date of Patent: Feb. 18, 1986

[54] ROADWAY PATCHING ATTACHMENT FOR DUMP TRUCKS

[76] Inventors: James F. Jones, 16331 N. Tamarack La., Nine Mile Falls, Wash. 99026; George O. Prufer, Rte. 2, Box 488, Deer Park, Wash. 99006

[21] Appl. No.: 537,726

[22] Filed: Sep. 29, 1983

[51] Int. Cl.[4] ..... E01C 19/48

[52] U.S. Cl. ..... 404/96; 404/98; 404/103; 404/104; 404/108

[58] Field of Search ..... 404/96, 98, 101, 103-105, 404/107, 108, 110; 298/1 R, 17.6, 22 R, 22 P; 291/25; 222/166, 608

[56] References Cited

U.S. PATENT DOCUMENTS

| | | | |
|---|---|---|---|
| 1,457,928 | 6/1923 | Johnson | 404/110 |
| 1,994,812 | 3/1935 | Deicke | 404/108 |
| 2,116,503 | 5/1938 | Arndt | 404/104 |
| 2,188,553 | 1/1940 | Lathrop | 404/104 |
| 2,327,385 | 8/1943 | Armington | 404/108 |
| 2,842,036 | 7/1958 | Overman | 404/103 |
| 3,347,138 | 10/1967 | Lunde | 404/107 |
| 3,515,041 | 6/1970 | Murtaugh | 404/108 |
| 3,815,824 | 6/1974 | Olson | 404/101 X |
| 4,311,408 | 1/1982 | Wren | 404/104 |

*Primary Examiner*—Stephen J. Novosad
*Assistant Examiner*—Beverly E. Hjorth
*Attorney, Agent, or Firm*—Wells, St. John & Roberts

[57] ABSTRACT

An attachment for dump trucks having a dump bed with a chute leading downwardly to a discharge end for discharging material along a roadway surface. The attachment adapts the truck to perform roadway surface repairs by receiving, grading, and pressing roadway repair material into place along damaged areas of the roadway surface while the truck is driven forwardly. The attachment includes a blade that is pivoted to the truck at a position rearwardly adjacent the chute discharge end. The blade is arched to receive and grade loose bulk repair material delivered from the dump truck bin through the downwardly projecting chute. The blade is also pivoted between an operative position, riding along the roadway surface, and an inoperative position above the roadway surface. Material delivered to the blade and graded thereby can be compacted and pressed into damaged roadway areas by the supporting truck tires.

20 Claims, 5 Drawing Figures

ROADWAY PATCHING ATTACHMENT FOR DUMP TRUCKS

FIELD OF THE INVENTION

The present invention relates to attachments to dump trucks for spreading roadway repair bulk material delivered through a discharge chute on the truck.

BACKGROUND OF THE INVENTION

Asphalt composition roadways become damaged due to wear and seasonal changes. The damage is usually in localized areas, however, so complete replacement of the roadway surface does not become necessary for an extended period of time. The damaged areas instead are typically repaired by hand, using cold or hot mix asphalt compositions.

The typical repair is made using a truck for delivering the premixed composition to the damaged area. Several workers then shovel the material from the truck and into the damaged areas. The workers use their shovels to roughly level the loose patch material within the damaged area. The roughly leveled material is then roll pressed. Such patching takes a considerable amount of time and is a tedious job for the workers. This is especially true when shoulder patching is required. Shoulder patching involves is a patching process that extends often for long stretches of the roadway where the shoulder of the hardened roadway surface has been damaged or broken. The workers must move along behind a moving truck, shovelling the material into the damaged shoulder area and leveling the fill material as they move forwardly. The full length of the patch area is then rolled to press the roughly leveled material into the damaged shoulder area to complete the repair.

Modern "sanding" trucks are used extensively for treating icy roadway surfaces during cold weather months. These trucks typically include a forwardly dumping bed for receiving sand and chemicals. The bed may include a forward chute discharge that is situated to one side of the bed and ahead of the rear wheels. The material is discharged as the bed is tipped forwardly. The sand discharged through the chute can be spread across the roadway surface and simultaneously provide traction for the truck as it moves along. The forward dumping capability and discharge chute is not used during the warmer seasons. Instead, the truck can be used as a typical rearward dumping truck so long as provisions are made for hoisting the dump bed rearwardly. There is a need to decrease the time and labor required for roadway patching procedures. There is also a need to make maximum use of roadway treating equipment such as the above mentioned "sanding" trucks. The present invention, as will be seen below, fulfills both these needs.

DETAILED DESCRIPTION OF A PREFERRED EMBODIMENT

Figure 1:
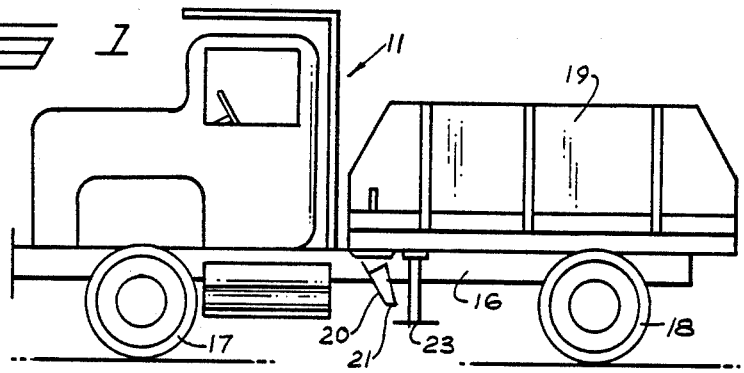
FIG. 1 is a diagrammatic view of a typical sanding truck having a forward discharge chute and sand spreading fitting thereon.

The present attachment is generally indicated in the drawings by the reference numeral 10. The attachment 10 is provided for dump trucks 11 (FIG. 1) to receive a loose, bulk roadway repair material 12 such as hot or cold asphalt mix and evenly apply the material 12 to damaged areas 14 adjacent a relatively flat roadway surface 13. The surface 13 may be formed of asphalt "blacktop" or other appropriate roadway surface.

The dump truck 11 shown in FIG. 1 will be generally described for later purposes in describing and defining the present invention. The dump truck 11 includes a rigid frame 16 and includes front wheels 17 and rear wheels 18. A dump bed 19 is carried on the frame. A discharge chute 20 is associated with the dump bed 19 for delivering loose bulk materials from the dump bed 19 onto the roadway surface. The chute 20 shown in FIG. 1 is positioned alongside the frame 16 on the left or driver's side of the vehicle. It is also situated forwardly of the rear wheels 18.

Figure 2:
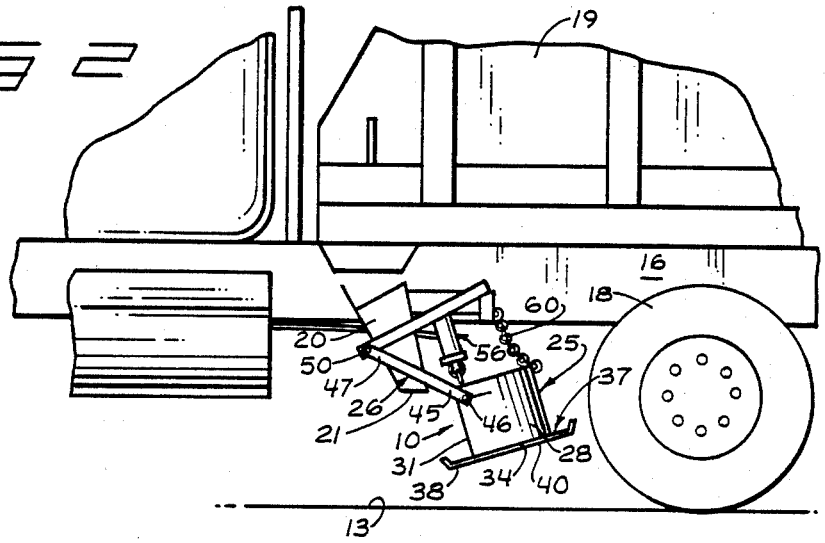
FIG. 2 is a fragmented view of the truck with the present attachment mounted thereon in an inoperative position.
Figure 3:
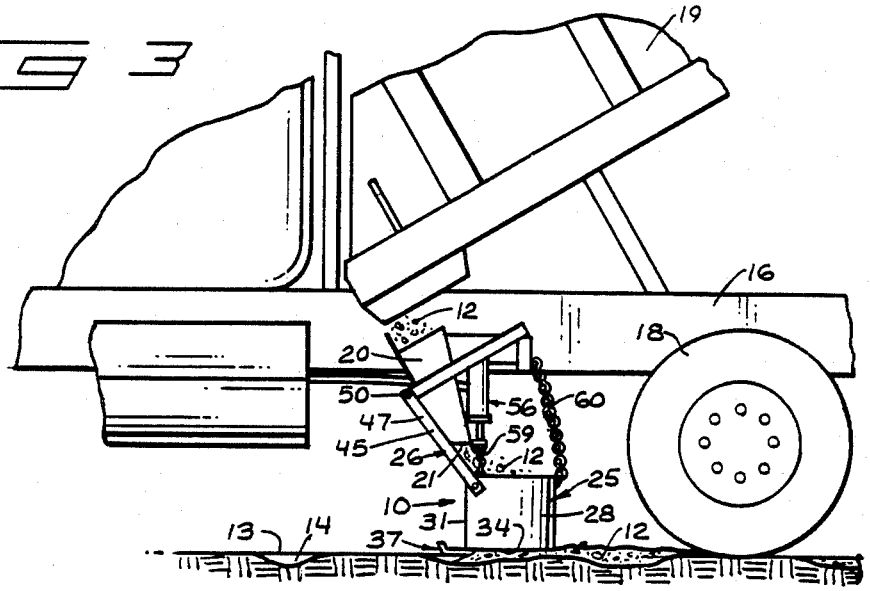
FIG. 3 is a view similar to FIG. 2 only showing an operative position of the present attachment.
Figure 4:
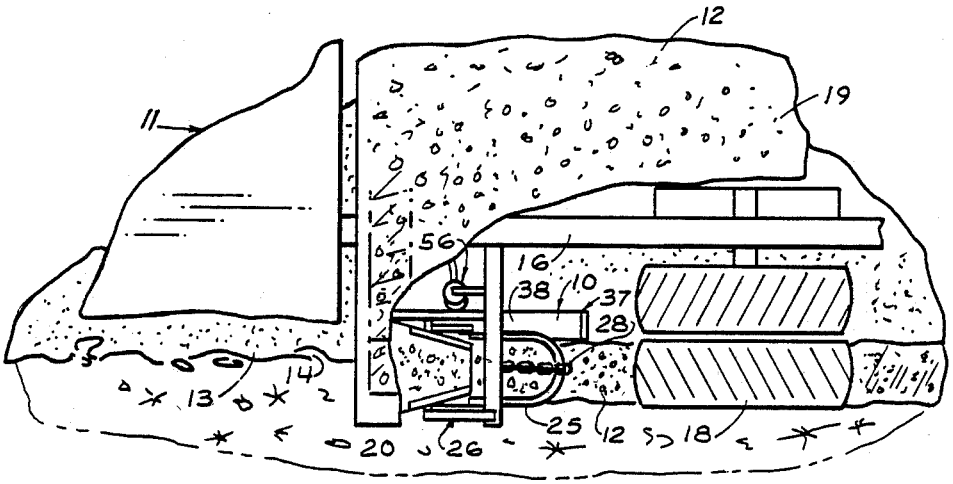
FIG. 4 is a fragmented plan view of the present attachment in operation.

Trucks having this particular chute orientation are ordinarily supplied with a spreader wheel 23 slightly rearward of the chute. The spreader wheel is used to cast sand or chemicals received through the chute across the entire roadway surface as the truck is moved along over icy roadway surfaces. This wheel 23 may be easily removed. FIGS. 2 through 4 thus illustrate the chute area of the truck with the spreader wheel 23 removed.

The present invention is comprised of a spreader generally shown at 25 and means 26 by which the spreader may be attached to the dump truck 11 adjacent the chute discharge end 21. This assembly may be arranged in relation to the discharge chute of the dump truck such that material discharged from the chute is received ahead of the spreader along the roadway surface 13. The spreader, moving along with the truck, will then grade the material to a prescribed level and spread it across the damaged area at a prescribed level in relation to the surface 13. The position of the spreader in relation to the truck is such that the rear wheel 18 immediately behind the spreader will press against the material and flatten it to complete the repair.

The spreader is shown in substantial detail in FIGS. 2 through 5. It includes an arched blade 28 having a concave front face 29 and a convex back face 30. The faces 29 and 30 extend between upright blade ends 31 and elevationally between a top edge 32 and a bottom grading edge 34.

The blade can be constructed of a rigid, wear resistant material such as steel. The blade can have a thickness dimension between the faces 29 and 30 of approximately one half inch. This lends significant rigidity to the blade and increases its wear resistance due to shear bulk of material comprising the blade. Furthermore, the blade thickness and dimensions given below assure a relatively heavy blade weight that is necessary for proper operation.

It is preferred that the blade have a width dimension between ends 31 that is substantially equal to the width of the trailing rear tire of the wheel 18. We have found a dimension of approximately 16" is serviceable. However, this dimension may vary with the nominal tire width being used since it is preferred that the entire width of spread material be covered by the tire tread for best results.

Figure 5:
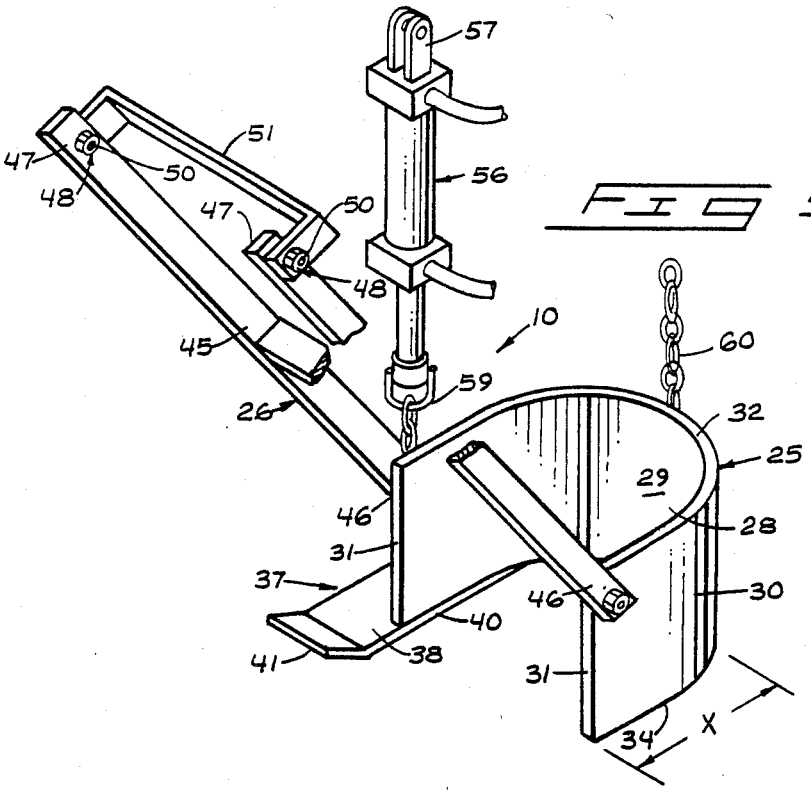
FIG. 5 is a fragmented detail view of the present attachment.

The height dimension between the top blade edge 32 and bottom grading edge 34 may vary slightly but is preferred to be approximately 12". This dimension allows sufficient buildup of loose material received from the chute without spillage. This condition is also facilitated by the depth dimension of the blade. The blade "depth" is the dimension across the blade from the ends 31 to the approximate center of the concave face 29. The depth dimension is indicated in FIG. 5 by the reference character "X" and may be approximately 13".

The "scoop" or "cupped" nature of the blade with the above depth dimension has been developed through experimentation to contain sufficient repair material received from the chute 20 while the truck 11 is driven forwardly at a speed between 3 and 8 miles per hour. The speed can be selectively controlled by the driver who may watch the application of material from his driver's position in the truck cab.

The bottom grading edge 34 of the blade is held parallel to the roadway surface 13 by means generally shown at 37. Means 37 may comprise a rigid skid 38 attached to the blade 28 adjacent one end thereof. The skid 38 includes a downwardly facing flat wear surface 40 that extends outward from one blade end 31 to a side opposite the remaining blade end. The skid includes a front end 41 that is situated forwardly of the blade and is upturned to facilitate sliding motion of the skid along the roadway surface.

It is preferred that the skid be situated on a side of the blade as shown in FIG. 4 that is inward with respect to the truck frame. The skid may thus ride across undamaged roadway surface 13, carrying the blade along over the damaged area with the bottom grading edge 34 substantially parallel to the roadway surface. The grading edge 34 will therefore leave a relatively smooth surface of the loose repair material at an elevation slightly higher than the roadway surface elevation. The aligned rear wheel of the truck will then roll over the graded patch to press the loose material downwardly and compact it to the level of the existing roadway surface.

The skid 38 and blade 28 may be provided as an integral unit. Alternatively, the skid 38 can be mounted by appropriate means (not shown) that would facilitate its removal and replacement following wear.

The spreader 25 is attached by means 26 to the truck 11. Means 26 may include a frame 45 extending from the blade 28 for attachment to the truck 11. The frame includes ends 46 that are pivotably mounted to the blade 28. Opposite frame ends 47 may be attached to the truck by means shown at 48 adjacent the chute discharge end. The frame may thus function as means for positioning the spreader blade at an operative position as shown in FIG. 3 or an inoperative position as shown in FIG. 2.

Means 48 may be comprised of pivot pins or bolts 50 extending through the upper frame ends 47 and attached by a bracket 51 to the chute 20. The bracket 51 may be secured to the chute by conventional fastening mechanisms or methods (not shown) such as threaded fasteners or by welding. The pivot axes for the frame 45 and blade 28 are preferably horizontal and substantially parallel with the roadway surface. It is also preferred that the axes be situated upward and forwardly of the blade. This allows the full weight of the blade to rest against the roadway surface (via the skid 38). Also, elevational movement of the blade (as the skid slides over the contours of the roadway surface) will be nearly vertical but with a slight rearward motion. This enables the blade to "hop" over oversize irregularities or sharp abrupt elevational changes in the damaged area that could otherwise catch and tear the blade from its mount.

The blade can be lifted or lowered between the operative and inoperative positions shown in FIGS. 2 and 3 by a cylinder 56. Alternatively, a simple chain 60 with an appropriate adjustment device such as a turnbuckle or chain tightener, can also be used to suspend the blade in either position.

The cylinder 56 includes an end 57 that is mountable to the truck 11. An opposite end 58 is connected by a loose link arrangement 59 to the blade 28. The link 59 allows the blade to "float" along the roadway surface as it is pulled along by the truck rather than fixing the blade at a set elevation. This is desirable since the weight of the blade and associated elements has been found to be sufficient to effectively spread roadway repair material without requiring additional downward forces.

The present attachment is mountable to the truck 11 after the sand spreader wheel 23 has been removed. This may be accomplished simply by unbolting the wheel 23 from the frame and disconnecting its drive mechanism from the truck hydraulics. The wheel 23 can be re-installed at any time there is a need for the truck to operate as a sander. Actually, the changeover may only be required once a year since nearly all sanding is done in the winter and all repair work is preferably done in the warm months. In any regard, it is a relatively simple and quick operation to mount or remove, the spreader 23 or to mount or remove the present attachment 10.

The present attachment is installed on the dump truck 11 simply by attaching the bracket 51 to the chute 20 and connecting the cylinder 56 or chain 60 to the truck frame. This is done by bolting or welding the bracket to the chute and by bolting the cylinder to an appropriate flange on the vehicle frame. The bracket 51 can then remain constantly on the chute. The chain 60, if used instead of cylinder 56, may simply be bolted to the truck frame 16.

The cylinder may be connected to the hydraulic circuits typically supplied with such trucks. Appropriate valving (not shown) may be provided or existing valving may be used such as that previously used to control operation of the spreader wheel 23.

The initial height setting for the bracket 51 before it is attached may be accomplished by simply resting the spreader 25 along a roadway surface in position ahead of the adjacent rearward wheel. The frame is then attached to the bracket 51. The bracket is slid into position along the chute by sliding the spreader into position below and slightly rearward of the chute discharge 21. The frame will hold the bracket in position to be attached by bolts or welding to the chute. The cylinder and chain may then be appropriately connected to the vehicle frame.

When the attachment is to be removed, the pins or bolts defining the pivot 50 can simply be removed to detach the frame and spreader 25. The bracket 51 can be left in place. Next, the cylinder is detached and hydraulic connections are broken, allowing the complete attachment to be removed from the truck. The spreader wheel can then be re-installed.

To operate the present attachment, the driver simply moves his truck into proper alignment with the area to be treated along the roadway surface. Alignment is preferably such that the skid 38 will ride along an undamaged area of the roadway surface while the blade 28 projects outwardly over the damaged area 14 as shown in FIG. 4. An appropriate control within the truck can then be operated to begin discharge of roadway repair material from the dump bed 19 and into the chute 20. This may be accomplished by tipping the bed up and forwardly as indicated in FIG. 3. An auger (not shown) typically provided in the bed can simultaneously be driven to feed material to the chute 20.

The discharged material will be received by the chute 20 and directed downwardly from the chute discharge end 21. This material is received just ahead of the spreader blade 28. As the truck moves forwardly, the spreader blade 28 will accumulate the deposited material within its arched confines and move the material along forwardly. The accumulated material is spread across the width of the blade and is discharged underneath the bottom grading edge 34.

The bottom edge 34 is held by the skid 38 at a slightly higher elevation than the roadway surface so the level of spread material will be slightly higher than the roadway surface. The loose, graded material, is compacted to the level of the roadway surface as the truck moves along. The rearward wheel in alignment with blade 28 will roll over the loose material and compact it to the level of the roadway surface. If additional rolling is needed, the truck can be driven back over the deposited material until a desired compaction is obtained. The corresponding widths of blade and rear wheel widths however, is such that it is possible that some shoulder or other patching repair may be completed with a single pass of the vehicle.

The present attachment has been tested extensively to determine if the quality of repair produced thereby can compare to that of similar repair made by hand labor. It has been found that such repair work is favorably comparable to that conducted by hand labor and, in addition, can be accomplished at a much higher rate of speed.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A roadway shoulder repair attachment for dump trucks having front and rear wheels, a roadway bulk material receiving dump bed and a chute leading downwardly from the dump bed between the front and rear wheels and substantially aligned with one of the rear wheels, for discharging the bulk roadway material from a discharge end thereof as the truck is moved forwardly; the attachment comprising:

a spreader blade;

means for positioning the spreader blade at an operative position adjacent the chute discharge end forward of the one rear wheel such that material discharged from the chute is received ahead of the spreader blade along the roadway, and so the spreader blade will grade the material to a prescribed level in relation to the roadway surface as the associated truck is moved forwardly and so the one rear wheel will roll over and compress the material graded by the spreader blade as the truck is moved forwardly.

2. The attachment as claimed by claim 1 wherein the blade includes a bottom grading edge and means for holding the grading edge parallel with the roadway surface as the truck is moved forwardly.

3. The attachment as claimed by claim 2 wherein the means for holding the grading edge is comprised of a skid mounted to the blade for supporting the blade on the roadway and having a wear surface thereon for sliding along a roadway surface.

4. The attachment as claimed by claim 1 wherein the means for positioning the spreader blade includes:

a frame member pivotably mountable to the truck and mounting the blade for pivotal motion therewith; and means mountable between the truck and frame member for selectively pivoting the frame member and blade between the operative blade position and an inoperative position upwardly clear of the roadway and chute.

5. The attachment as claimed by claim 1 for tire supported dump trucks wherein the blade has a width dimension substantially equal to the width of the dump truck tire.

6. The attachment as claimed by claim 1 wherein the blade is concave and mountable by said means to the truck with the blade concavity facing forwardly.

7. The attachment as claimed by claim 1 wherein said means for positioning the blade includes suspension means by which the blade is allowed to move freely elevationally to conform to the roadway surface as the truck moves forwardly.

8. The attachment as claimed by claim 1 for wheeled dump trucks wherein the scraper blade includes a concave face surface extending between opposed blade ends, said blade being mountable to the truck by the positioning means with the concavity facing forwardly in relation to the forward direction of travel and wherein the distance across the concave blade face between the opposed blade ends is substantially equal to the width of the one rear truck wheel.

9. In combination with a dump truck having a frame with front and rear wheels and a bulk roadway repair material receiving dump bed mounted thereon for discharging bulk roadway material onto a shoulder area of a roadway surface from the discharge end of a downwardly projecting chute situated between front and rear wheels and on one side of the frame as the truck is moved forwardly along the surface, a roadway material spreader comprising:

a blade having a bottom grading edge thereon;

a carrying frame mounting the blade at one end thereof and extending from the blade to a remote end;

means for mounting the carrying frame at the remote carrying frame end to the truck frame between the front and rear wheels and adjacent the chute for movement in relation to the chute discharge end; and skid means on the blade for slidably supporting the blade from the roadway surface when in its operative position for movement over the shoulder area of the roadway surface.

10. The combination with the dump truck as claimed by claim 9 wherein the blade includes a concave face surface extending between opposed blade ends, with the concavity facing forwardly in relation to forward motion of the truck.

11. The combination with the dump truck as claimed by claim 9 further comprising:

suspension means between the truck and blade for elevationally moving the blade between an operative position adjacent the roadway in which the blade is allowed to move elevationally to conform to the roadway surface, and an elevated inoperative position upwardly clear of the roadway surface.

12. The combination with the dump truck as claimed by claim 9 wherein the blade includes an inward end in relation to the truck frame, and an outward end, and wherein the skid means is mounted to the inward end of the blade.

13. A roadway repair material spreader for a dump truck having chute discharge situated to one side of the truck and between forward and rearward wheels thereof, said spreader comprising:

an arched blade having a top edge and a bottom grading edge extending between opposed blade ends;

a skid attached to the arched blade at one end thereof and having a bottom skid surface thereon spaced downwardly, in relation to the top and bottom blade edges, from the bottom grading edge; and carrying frame means for positioning the arched blade adjacent the chute discharge of the truck, forward of the rear truck wheel such that material discharged through the chute is received and spread by the arched blade as the truck is moved forwardly and such that the spread material is pressed by the rear wheel as the truck moves forwardly.

14. The spreader as claimed by claim 13 wherein the bottom skid surface is parallel to the bottom grading edge of the arched blade.

15. The spreader as claimed by claim 13 wherein the arched blade includes a concave front face and the skid includes a forward end in relation to the front blade face that is upturned toward the blade top edge.

16. The spreader as claimed by claim 13 wherein the skid is attached to the blade along one of said blade ends and wherein the skid surface extends to a side of the one blade end opposite the remaining blade end.

17. The spreader as claimed by claim 13 wherein the distance across the arched blade between ends is approximately 16 inches.

18. The spreader as claimed by claim 13 wherein the distance between the top blade edge and bottom grading edge of the blade is approximately 12 inches.

19. The spreader as claimed by claim 13 wherein the blade is arched between the blade ends and wherein the depth of the arch from the blade ends is approximately 13 inches.

20. The spreader as claimed by claim 13 wherein the blade is constructed of a heavy wear resistant sheet material such as steel plate and wherein the steel plate is approximately ½ inch thick.

* * * * *